US010157689B2

(12) United States Patent
Washington, II et al.

(10) Patent No.: US 10,157,689 B2
(45) Date of Patent: Dec. 18, 2018

(54) REINFORCED RADIOLOGICAL CONTAINMENT BAG

(71) Applicant: Savannah River Nuclear Solutions, LLC, Aiken, SC (US)

(72) Inventors: Aaron L. Washington, II, Aiken, SC (US); Michael G. Serrato, Aiken, SC (US); Joseph A. Teprovich, Aiken, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 889 days.

(21) Appl. No.: 14/573,499

(22) Filed: Dec. 17, 2014

(65) Prior Publication Data

US 2016/0180979 A1 Jun. 23, 2016

(51) Int. Cl.

| | |
|---|---|
| ***G21F 5/015*** | (2006.01) |
| ***G21F 1/10*** | (2006.01) |
| ***B65D 30/08*** | (2006.01) |
| ***B65D 85/82*** | (2006.01) |

(52) U.S. Cl.

CPC ..... *G21F 5/015* (2013.01); *B65D 31/04* (2013.01); *B65D 85/82* (2013.01); *G21F 1/10* (2013.01)

(58) Field of Classification Search

CPC ..... G21F 5/015; G21F 1/10; B65D 85/82; B65D 31/04

See application file for complete search history.

(56) References Cited

U.S. PATENT DOCUMENTS

| | | | | |
|---|---|---|---|---|
| 4,001,587 A | | 1/1977 | Panchenkov et al. | |
| 5,062,186 A | | 11/1991 | Rampolla et al. | |
| 5,076,971 A | | 12/1991 | Barker | |
| 5,640,705 A | * | 6/1997 | Koruga | B82Y 30/00 252/625 |

(Continued)

FOREIGN PATENT DOCUMENTS

| | | |
|---|---|---|
| DE | 10 2005 057 428 B3 | 8/2007 |
| WO | 2004/081101 A2 | 9/2004 |
| WO | WO 2005/060671 A2 | 7/2005 |

OTHER PUBLICATIONS

Milo Shaffer et al. Fabrication and Characterization of Carbon Nanotubes/Poly(vinyl alcohol) Composites, Adv. Mater/ 1999, 11, No. 11, p. 937-941 (Year: 1999).*

(Continued)

*Primary Examiner* — Peter F Godenschwager
*Assistant Examiner* — Andrew J. Oyer
(74) *Attorney, Agent, or Firm* — Dority & Manning, P.A.

(57) ABSTRACT

Radiological containment bags for use in storing alpha particle emitting waste are described. The radiological containment bags are formed of a multilayer film with an inner layer of the film being a sacrificial layer that lies between the interior of the bag and a structural polymeric layer. The sacrificial layer includes a flexible composite material that in turn includes a polymeric matrix and an alpha particle energy absorber incorporated in the polymeric matrix. The sacrificial layer can include a chromophore that can detect early degradation of the sacrificial material.

17 Claims, 2 Drawing Sheets

(56) References Cited

U.S. PATENT DOCUMENTS

| | | | | |
|---|---|---|---|---|
| 5,814,824 | A | 9/1998 | Hamby et al. | |
| 6,276,214 | B1 * | 8/2001 | Kimura | G01L 1/2293 73/795 |
| 6,355,078 | B1 | 3/2002 | Wickland | |
| 6,373,064 | B1 | 4/2002 | Yao et al. | |
| 7,631,758 | B2 | 12/2009 | Stennes et al. | |
| 2002/0060300 | A1 | 5/2002 | O'kane, Sr. et al. | |
| 2004/0200997 | A1 | 10/2004 | Soundararajan | |
| 2004/0211917 | A1 | 10/2004 | Adamovics | |
| 2005/0203229 | A1 | 9/2005 | Soundararajan | |
| 2005/0208290 | A1 | 9/2005 | Patel | |
| 2006/0054488 | A1 | 3/2006 | Harmon et al. | |
| 2006/0145091 | A1 | 7/2006 | Patel | |
| 2007/0067882 | A1 * | 3/2007 | Atanasoska | A61L 27/34 606/192 |
| 2007/0237829 | A1 | 10/2007 | Dadachova et al. | |
| 2007/0281244 | A9 | 12/2007 | Kasperchik et al. | |
| 2008/0128659 | A1 | 6/2008 | Parker et al. | |
| 2009/0114857 | A1 | 5/2009 | DeMeo et al. | |
| 2011/0300360 | A1 | 12/2011 | Basfar et al. | |
| 2012/0217161 | A1 * | 8/2012 | Chan | C12Q 1/6809 204/451 |
| 2012/0248346 | A1 | 10/2012 | Chwdhary et al. | |
| 2012/0273622 | A1 | 11/2012 | Long | |
| 2013/0095307 | A1 | 4/2013 | Bennington et al. | |
| 2013/0119316 | A1 * | 5/2013 | Sauti | G21F 1/00 252/478 |
| 2013/0270442 | A1 | 10/2013 | Penumadu et al. | |

OTHER PUBLICATIONS

Atwell et al. "Metal hydrides, MOFs, and Carbon composites as Space Radiation Shield Mitigators, 44th International Conference on Environmental Systems", Paper 103 (Jul. 2014), (Year: 2014).*

Pentimalli et al. "A metal hydride-polymer composite for hydrogen storage application", Energy Conversion and Management, 50 (2009), 3140-3146 (Year: 2009).*

Savannah River Nuclear Solutions, LLC; International Patent Application No. PCT/US2015/66250; International Search Report dated Mar. 11, 2016; 2 pages.

Harrison, Courtney; Weaver, Sean; Bertelsen, Craig; Burgett, Eric; Hertel, Nolan; Grulke, Eric (2008) Polyethylene/Boron Nitride Composites for Space Radiation Shielding *J. of Applied Polymer Science*, 109, 2529-2538.

Lehnherr, Dan; Tykwinski, Rik R. (2011) Conjugated Oligomers and Polymers Based on Anthracene, Teracene, Pentacene, naphthodithiophene, and Anthradithiophene Building Blocks *Australian Journal of Chemistry* 64(7) 919-929.

Shepherd, Whitney E.B.; et al. (2010) Optical, photoluminescent, and photoconductive properties of functionalized anthradithiophene and benzothiophene derivatives; Chapter 1 in "*Advances in Lasers and Electro Optics*"edited by N. Costa and A. Cartaxo, Intech, pp. 1-32, Apr. 2010.

Stowe, Ashley; Teprovich, Joseph Jr.; Knight, Douoglas; Wellons, Matthew; and Zidan, Ragaly (2011) "Catalytic Carbon Nanostructures and Novel Nanocomposites for Hydrogen Storage," *Journal of the South Carolina Academy of Science*: vol. 9: Iss. 1, Article 7.

* cited by examiner

REINFORCED RADIOLOGICAL CONTAINMENT BAG

STATEMENT AS TO RIGHTS TO INVENTIONS MADE UNDER FEDERALLY SPONSORED RESEARCH

This invention was made with Government support under Contract No. DE-AC09-08SR22470 awarded by the United States Department of Energy. The Government has certain rights in the invention.

BACKGROUND

Polymeric containment bags are commonly utilized for handling, storage, and transport of radiological residue and debris. For instance, nuclear facility deactivation and decommissioning activities generate significant volumes of radiological waste, a portion of which is transported and/or stored in polymeric containment bags, often in conjunction with secondary metal containment storage. For example, the most common method for packaging and storing $^{238}$PU during decontamination operations involves placing the waste material into a plastic container/bag and then storing that container in metal containers.

Unfortunately, known containment bags exhibit less than ideal resistance to radiological degradation effects such as deterioration due to alpha particle induced radiolysis and electron excitation. Specifically, alpha particle emission from the $^{238}$Pu molecules interacts with the plastic container causing radiolysis within the polymer makeup of the plastic material leading to the decomposition of the bag. This can allow permeation of the waste through the bag potentially causing contamination. Additionally, the radiolytic decomposition of the polymer hydrocarbon produces molecular hydrogen and causes hydrogen gas generation. This gas accumulation in the plastic container can cause a flammability danger and an over pressurization hazard.

Moreover, due to short life span of the bags, re-packaging of the waste is often required, which increases risk to both the workers and the environment, particularly as re-packaging is often carried out only after degradation has been detected and the containment field of the bag has been compromised.

What are needed in the art are containment bags that exhibit increased resistance to radiological degradation events, and in particular alpha particle emission. Containment bags that can signal effects of degradation prior to compromise of the containment field of the bag would also be of great benefit.

SUMMARY

Aspects and advantages of the invention will be set forth in part in the following description, or may be obvious from the description, or may be learned through practice of the invention.

In one embodiment disclosed herein is a radiological containment bag that includes a multilayer film. The multilayer film has an inner surface and an opposite outer surface, with the inner surface facing the interior of the containment bag. In addition, the multilayer film includes a polymeric layer and a sacrificial layer, with the sacrificial layer being closer to the inner surface of the multilayer film as compared to the polymeric layer. The sacrificial layer includes a flexible composite material that in turn includes a polymeric matrix and an alpha particle energy absorber incorporated in the polymeric matrix. More specifically, the alpha particle energy absorber can include a conjugated ring system of at least two conjugated rings.

In one embodiment, the alpha particle energy absorber can be a chromophore and, upon degradation of the sacrificial layer, the photonic emission characteristics and/or the color of the chromophore can vary in a detectable fashion. Accordingly, in this embodiment the sacrificial coating can provide early detection of degradation of the containment bag and thus loss of the containment field provided by the bag can be avoided.

In one embodiment, the multilayer film can also include a detection layer that is closer to the outer surface of the multilayer film as compared to the polymeric layer. In this embodiment, the detection layer can include a chromophore that, upon degradation of the detection layer, varies in photonic emission characteristics and/or color in a detectable fashion. Thus, in this embodiment, following breach of the inner sacrificial layer and subsequent breach of the polymeric layer due to, e.g., alpha particle emission from the contained materials, the detection layer can provide a clearly detectable signal as the chromophore is affected by the emitted energy.

The containment bag can include other beneficial components as well, for instance the sacrificial layer can include multiple alpha particle energy absorbers, such as a first alpha particle energy absorber that is a chromophore and a second alpha particle energy absorber with extremely high electron density, such as a fullerene (e.g., $C_{60}$). In one embodiment, the sacrificial layer can carry a net positive charge, which can repel alpha particles on the nanometer scale and further extend the useful life of the containment bag.

Also disclosed is a method for forming the containment bag. The method can include forming a composite by combining the polymer of the polymeric matrix with the alpha particle energy absorber; forming a multi-layer film by applying the composite to a surface of a polymeric layer and thereby forming a sacrificial layer on the polymeric layer; and manipulating the multi-layer film to form the containment bag such that the sacrificial layer is retained on the inner side of the polymeric layer of the containment bag.

Also disclosed is a method for storing radiological materials. The method can include placing the radiological materials within a containment bag and monitoring the containment bag for variation in the emission spectrum and/or the color of a chromophore that is included in the sacrificial layer on the inner surface of a polymeric layer of the containment bag.

These and other features, aspects and advantages of the present disclosure will become better understood with reference to the following description and appended claims.

BRIEF DESCRIPTION OF THE FIGURES

A full and enabling disclosure of the present invention, including the best mode thereof, directed to one of ordinary skill in the art, is set forth in the specification, which makes reference to the appended figures, in which.

DETAILED DESCRIPTION

It is to be understood by one of ordinary skill in the art that the present discussion is a description of exemplary embodiments only, and is not intended as limiting the broader aspects of the present disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure is generally directed to radiological containment bags with a longer useful life, methods of forming the containment bags, and methods for utilizing the containment bags. More specifically, the radiological containment bags are reinforced to include a sacrificial layer on the interior of the bags. The sacrificial layer provides a barrier between the radiological waste contained in the bag and the polymeric layer that forms the primary structure of the bag. The sacrificial layer can extend the life of the bag through energy absorption and optionally also through repulsion of alpha radiation from the radiological waste and thus delay or prevent degradation of the external polymeric layer.

The sacrificial layer can provide additional benefits to the radiological containment bags as well. For instance, in one embodiment the sacrificial layer can include a chromophore that can provide a detectable signal upon a predetermined degradation state of the sacrificial layer. This signal can be used to instigate re-packaging of the radiological waste prior to compromise of the containment field of the bag and thus prevent contaminant release, undesirable hydrogen gas production, and worker endangerment.

In another embodiment, the radiological containment bag can include a detection layer on the exterior surface of the bag, and a chromophore can be included in this exterior layer. In this embodiment, the chromophore can provide a detectable signal following a predetermined level of degradation of the sacrificial layer and the polymeric layer and upon instigation of degradation of the detection layer.

The sacrificial layer and optional detection layer can also provide mechanical strength to the bag, and can prevent the formation of tears or holes during use.

Figure 1:
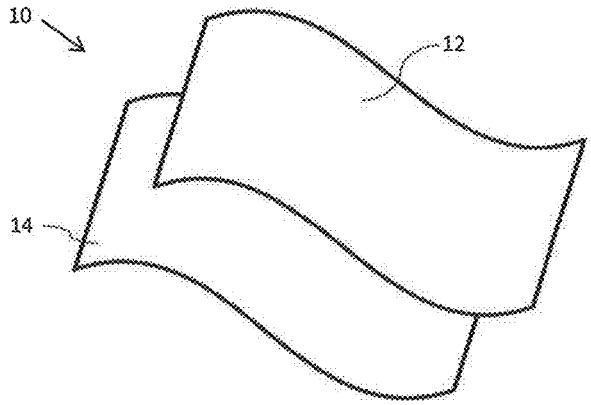
FIG. 1 schematically illustrates a multilayer film in an exploded view, the multilayer film including a polymeric layer and a sacrificial layer as described herein.

FIG. 1 schematically illustrates in an exploded view a multilayer film 10 that can be used in forming a radiological containment bag. The multilayer film 10 includes a polymeric layer 12 and a sacrificial layer 14, as shown.

The polymeric layer 12 can include any suitable polymeric material as is presently known for use in forming a containment bag. For instance, the polymeric layer 12 can include one or more thermoplastic polymers such as, without limitation, polyurethane, polyolefins (e.g., polyethylene, polypropylene), polyvinylchloride, polyvinylpyrrolidone, copolymers, polymer blends, etc. that can be used to form a flexible polymeric material for containment of radiological materials. The polymeric material can optionally include additives as are generally known in the art such as colorants, flow promoters, nucleators, lubricants, plasticizers (e.g., epoxy soybean oil, ethylene glycol, propylene glycol, etc.), emulsifiers, surfactants, suspension agents, leveling agents, drying promoters, adhesives, flow enhancers, flame retardants, etc. For instance, the polymeric material can include a yellow colorant, which can be utilized to designate radiological contamination of the contents.

The polymeric layer 12 can be translucent or transparent. While some amount of transparency is not a requirement of the polymeric layer 12, in those embodiments in which the containment bag includes a chromophore as a component of the interior sacrificial layer, the polymeric layer 12 will be at least translucent and in one embodiment will be transparent, so as to facilitate determination of a characteristic change in the chromophore of the sacrificial layer 14. In addition, some level of translucency can allow for workers to assess the contents of the containment bag.

The polymeric layer 12 can generally be an extruded or solution cast film and formed to have a thickness as is generally known in the art. For instance, the polymeric layer can be formed to a thickness of about 5 mils or greater, about 8 mils or greater, about 12 mils or greater, or about 20 mils or greater in some embodiments. For instance, the polymeric layer can have a thickness of from about 5 mils to about 30 mils, in some embodiments.

In conjunction with the polymeric layer 12, the multilayer film 10 includes a sacrificial layer 14. The sacrificial layer 14 includes a flexible composite material that includes a polymeric matrix and an alpha particle energy absorber incorporated in the polymeric matrix. The polymer of the polymeric matrix of the sacrificial layer 14 can be the same or different as a polymer of the polymeric layer 12. Exemplary polymers can include, without limitation, polyurethanes, polyamides, polyvinyl chloride, polyvinyl alcohols, natural latex, polyolefins (e.g., polyethylenes, polypropylenes), ethylene vinyl acetates, polyesters, polyisoprenes, polystyrenes, polysulfones, acrylonitrile-butadiene-styrene, polyacrylates, polycarbonates, polyoxymethylenes, polytetrafluoroethylenes, ionomers, celluloses, polyetherketones, polysiloxanes, elastomers, copolymers of any of the above, derivatives of any the above, polymer blends, etc.

Conventional additives as mentioned above may be combined with the polymer(s) in forming the polymeric matrix to improve the flexibility, strength, durability or other properties of the layer and/or to help insure that the composite material has an appropriate uniformity and consistency. Additives can generally be incorporated in the polymeric material in conventional amounts.

Additional additives may be included in the sacrificial layer that may increase the ability of the layer to absorb energy emitted from the contained materials. For instance, tungsten is known to be highly absorptive to alpha and gamma radiation and can be incorporated into the layer, for instance in the form of a salt such as sodium tungstate ($Na_2WO_2$). Aluminum can also be incorporated into the layer as a dopant to increase radiation absorption capabilities of the sacrificial layer. In one embodiment a chelating agent such as an anthracene derivative can be utilized to incorporate a metal dopant into the layer, which can mitigate solubility issues.

In one embodiment, the sacrificial layer can have a net positive charge, which can repel alpha particle radiation away from the sacrificial layer on the nanometer scale. A positive charge can be formed or included in the sacrificial layer according to any standard chemistry. For instance, a polymer of the flexible composite material can be a cationic polymer and contain net positively-charged atom/s or associated growls of atoms covalently linked to the polymer backbone. Examples of cationic groups as may be incorporated on the polymer backbone can include, for example ammonium, phosphonium and/or sulfonium cations. Such functional group incorporation can be carried out according to standard chemistry, the preferred method of which can depend upon the specific materials involved. For example, a reactive functional group can be linked to the polymer backbone by use of diisocyanates chemistry, disulfide chemistry, epoxy chemistry, acid anhydride chemistry, or the like.

Alternatively or additionally, the flexible composite polymeric material can include a cationic additive that can provide a positive charge to the sacrificial layer 14. Such cationic additives can include organonitrogen salts, organophosphorous salts, cationic organic sulphonium salts, cationic organic tin compounds, amphoteric surfactants, and the like. The organic groups of such salts may be alkyl, aryl, alkenyl or combinations thereof. For example, a quaternary ammonium salt such as diallyldimethylammoniumchloride or a quaternary imidazolinium salt can be included in the sacrificial layer 14, for instance in an amount of about 10% by weight or less of the composite material, and provide a net positive charge to the layer 14.

The sacrificial layer can also include an alpha particle energy absorber that can be incorporated in the polymeric matrix. More specifically, the energy absorber can be a semiconductive material that includes a conjugated ring system of at least two conjugated rings and as such, can have a relatively high electron density for effective absorption of energy from alpha particles emitted from the contained waste. For instance, the alpha particle energy absorber can have an electron density of about $5\times10^{23}$ electrons per cubic centimeter or greater, about $8\times10^{23}$ electrons per cubic centimeter or greater or about $1\times10^{24}$ electrons per cubic centimeter or greater. In one embodiment, the alpha particle energy absorber can have an electron density of from about $3\times10^{23}$ to about $1.5\times10^{24}$ electrons per cubic centimeter.

A material with a high electron density (i.e. a high mass density) is typically a better absorber of charged particle radiation. If the ionizing radiation consists of photons (ultraviolet rays, x-rays, or gamma rays), absorption is dominated by the photoelectric effect at low energies, then by Compton and pair production processes at successively higher energies (e.g., alpha particles). For Compton and pair production processes, the absorption is proportional to electron density, and a material with a high electron density (i.e. a high mass density) is a better absorber.

Electron density can be estimated according to standard modeling processes. For example, computer simulation or materials modeling may include a computational method based on Monte Carlo N-Particle Extended (MCNP-X) program. MCNP-X is a computational method that derives properties of the molecule or collection of molecules based on a determination of the electron density of the molecule. Unlike the wavefunction, which is not a physical reality but a mathematical construct, electron density is a physical characteristic of all molecules. A functional is defined as a function of a function, and the energy of the molecule is a functional of the electron density. The electron density is a function with three variables: x-, y-, and z-position of the electrons. Unlike the wavefunction, which becomes significantly more complicated as the number of electrons increases, the determination of the electron density is independent of the number of electrons?

In general, an alpha particle energy absorber can include one or more hydrocarbon aromatic moieties and/or heterocyclic aromatic moieties with at least two separate or fused rings, including from 3 to about 10 atoms in each ring.

In one embodiment, the alpha particle energy absorber can include carbon-based nanostructures such as graphene, fullerenes, carbon nanotubes, or elemental carbon (e.g., soot). Fullerenes can encompass carbon fused ring systems in any size and shape including spheres, ellipsoids, and nanotubes. For instance, the alpha particle energy absorber can encompass a $C_{60}$ fullerene in one embodiment.

Carbon-based structures can optionally be derivatized, for instance to improve incorporation into the polymeric matrix. By way of example, a carbon-based nanostructure can be modified with an oligomer as described in U.S. Pat. No. 8,674,134 to Zettl, et al. (incorporated herein by reference) so as to more uniformly disperse the alpha particle absorber throughout the polymer matrix.

Other derivatizations of carbon-based energy absorbers can include formation of composites with metal hydrides such as $NaAlH_4$, $LiAlH_4$, and $LiBH_4$ as described by Stowe, at al. (*Journal of the South Carolina Academy of Science,* 2011, 9(1) 13-19).

Other conjugated ring systems can be utilized as an alpha particle energy absorber alternative to or in conjunction with carbon-based nanostructures. For instance an alpha particle energy absorber can include combinations of substituted or unsubstituted electron-rich (or $\pi$-excessive) aryl or heteroaryl groups. Such classification is based on the average electron density on each ring atom as compared to that of a carbon atom in benzene. Examples of suitable electron-rich systems include heteroaryl groups having one or more heteroatom such as furan, pyrrole, and thiophene; and theft benzofused counterparts such as benzofuran, benzopyrrole, and benzothiophene. Conjugated oligomers and polymers are also encompassed herein that can include conjugated rings separated by a linear conjugated or nonconjugated chain. For instance, the alpha particle energy absorber can include conjugated monomers, oligomers or polymers based on anthracene, tetracene, pentacene, naphthodithiophene, and anthradithiophene building blocks.

The flexible composite material of the sacrificial layer can include a chromophore that can exhibit a change in photonic emission characteristics and/or a change in color as one or more components (e.g., the chromophore itself) of the layer are degraded due to interaction with the alpha particles emitted from the waste contained in the bag. As utilized herein, the term "photonic emission characteristics" generally refers to the photonic emission of a material following excitation of the material The term "color" generally refers to a natural characteristic of the material and is not dependent upon excitation of the material. Upon degradation of one or more components of the sacrificial layer, a chromophore can exhibit a change in photonic emission characteristics (the emission characteristics following subjection to a defined excitation energy) and can also exhibit a change in the natural color of the chromophore (i.e., the natural color with no excitation energy necessary). Alternatively, a chromophore can exhibit only one of these responses, i.e., either a change in photonic emission characteristics or a change in color.

Addition of a chromophore to the sacrificial layer can provide for early detection of degradation of the sacrificial layer and prevent loss of the containment field of the containment bag. In one embodiment, the chromophore can be the sole alpha particle energy absorber of the sacrificial layer. Alternatively the chromophore can be utilized in conjunction with a second alpha particle energy absorber that has a high electron density. For example, a chromophore can be incorporated in the sacrificial layer in conjunction with a fullerene that has a high electron density, such as $C_{60}$.

In one embodiment, the containment bag can include a detection layer on the exterior surface of the polymeric layer. In this embodiment, the detection layer can include a polymeric matrix and a chromophore that can exhibit a change in emission as one or more components (e.g., the chromophore itself) of the detection layer are degraded due to interaction with the alpha particles emitted from the waste contained in the bag. The polymeric matrix of the detection layer can include the same or different polymers as the sacrificial layer and/or the polymeric layer as described above.

When included, the detection layer can provide a detectable signal upon breach of the sacrificial and polymeric layers. The addition of a detection layer on the exterior surface may provide a clear signal of loss of the containment field of the containment bag. Of course, in those embodiments in which the containment bag includes a detection layer, the sacrificial layer can also include a chromophore, if desired.

Examples of suitable chromophores as may be incorporated in the sacrificial layer and/or in an optional detection layer include vinyl compounds containing substituted and unsubstituted phenyl, substituted and unsubstituted anthracyl, substituted and unsubstituted phenanthryl, substituted and unsubstituted naphthyl, substituted and unsubstituted heterocyclic rings containing heteroatoms such as oxygen, nitrogen, sulfur, or combinations thereof, such as pyrrolidinyl, pyranyl, piperidinyl, acridinyl, quinolinyl. Other chromophores are described in U.S. Pat. No. 6,114,085, and in U.S. Pat. Nos. 5,652,297, 5,763,135, 5,981,145, 6,187,506, 5,939,236, and 5,935,760, which may also be used, and are incorporated herein by reference, Exemplary chromophores as may be incorporated in the sacrificial and/or detection layers of a containment bag can include, without limitation, those having the following structures:

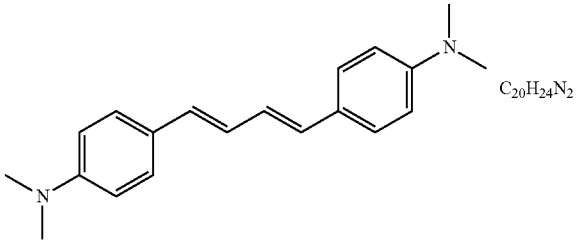

$C_{20}H_{24}N_2$

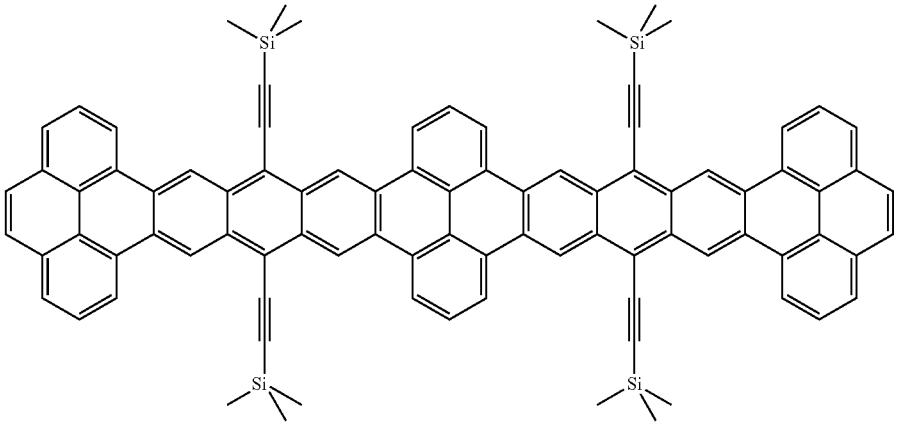

$C_{88}H_{66}Si_4$

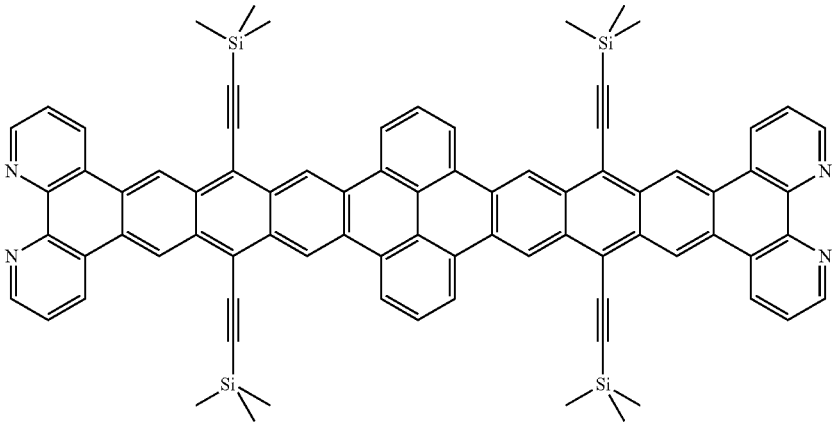

$C_{90}H_{62}N_4Si_4$

-continued
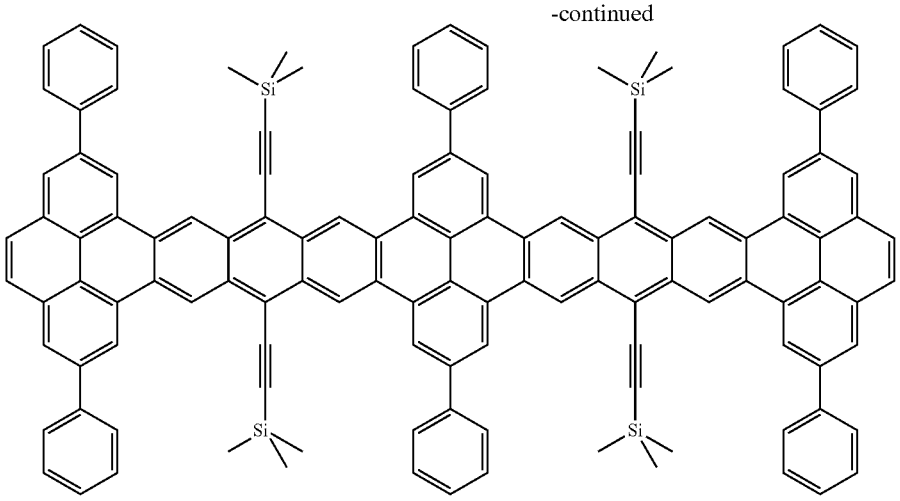
$C_{124}H_{90}Si_4$
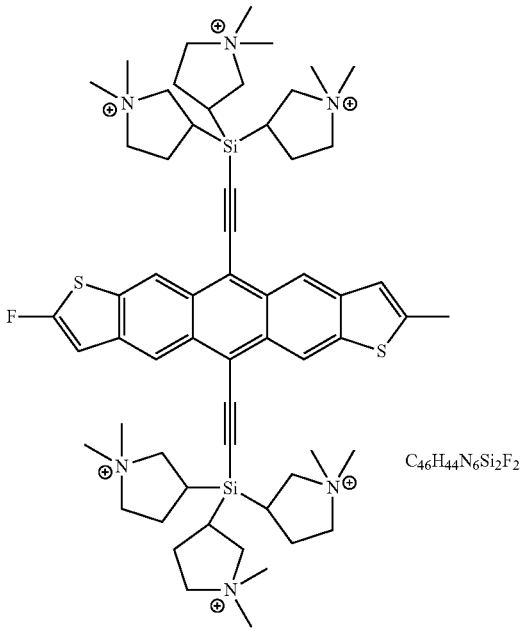
$C_{46}H_{44}N_6Si_2F_2$
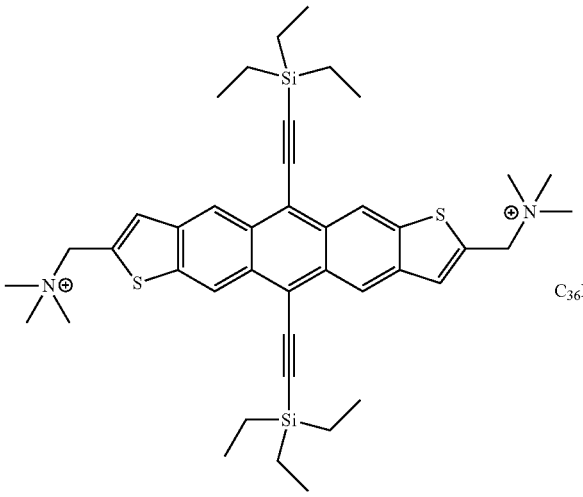
$C_{36}H_{46}Si_2N_2S_2$
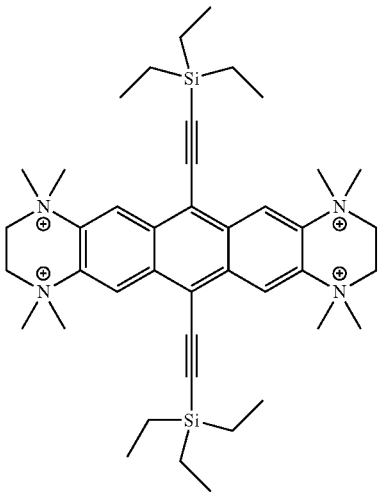
$C_{34}H_{50}N_4Si_2$ The composite material of the sacrificial layer including the polymeric matrix and the alpha particle energy absorber can generally include the energy absorber component (which can include a combination of two or more different alpha particle energy absorbers) in an amount of about 4% by weight of the composite material, about 3.25% by weight of the composite material or less, or about 0.80% by weight or less in some embodiments.

The components can be combined to form the flexible composite material of the sacrificial layer. For instance, the polymer can be combined with any desired additives (e.g., a cationic additive) to form a polymeric base material, and this polymeric material can then be blended with the alpha particle energy absorber. Alternatively, all desired additives can be combined at a single time with the polymer to form the composite material. In addition, the alpha particle energy absorber can be physically encapsulated within the polymer matrix of the layer or may be bound within or to the matrix, as desired.

When formed, the composite material can exhibit an amount of flexibility. As utilized herein, the term flexible generally refers to a material that is pliable and can bend without cracking or breaking.

Irregardless of the manner of combination, and with reference to FIG. 1, the composite material can be applied to a surface of the polymeric layer 12 to form the sacrificial layer 14 on the polymeric layer 12.

The multilayer composite 10 can be formed according to a co-extrusion process or alternatively, the two (or more) layers of the composite can be formed at different times and then combined. For instance, the sacrificial layer 14 can be extruded as a melt on the surface of the previously formed polymeric layer 12 or the composite material can be dissolved and applied to the surface of the polymeric layer 12 as a solution. For instance, a solution of the composite material can be spin-coated, drop-cast, spray-coated, or the like on the polymeric layer. Similarly, a detection layer can be formed on the previously formed polymeric layer on the opposite side as the sacrificial layer or co-formed, as desired. In addition, the sacrificial layer and the optional detection layer can be continuous or discontinuous across the surface of the polymeric layer, as desired.

In general, the additional layers, e.g., the sacrificial layer 14 can adhere to the polymeric layer 12 without the need for any adhesive layer between the two, but this is not a requirement of the disclosure, and in one embodiment an adhesive may be utilized between the adjacent layers.

Figure 2:
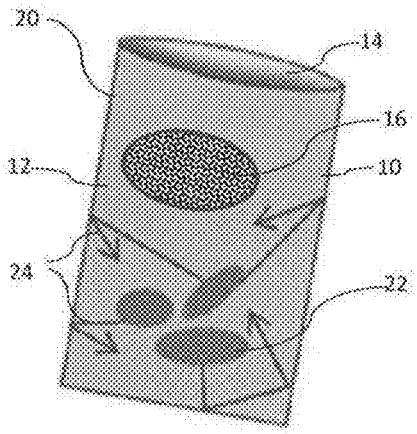
FIG. 2 schematically illustrates a containment bag as may be formed from the multilayer film.

The composite film can be utilized to form a containment bag 20 as illustrated in FIG. 2. More specifically, the composite film 10 can be manipulated in forming the containment bag 20 such that the sacrificial layer 14 is on the interior of the formed bag and the polymeric layer 12 is exterior to the sacrificial layer. In those embodiments in which the composite film includes a detection layer, the detection layer can be on the exterior surface of the polymeric layer, for instance in the form of a discontinuous layer or as a patch 16 that provides a detectable signal upon loss of the containment field of the bag 20.

The containment bag can be shaped and formed according to known methodology using, for example, by use of methods as described in U.S. Pat. No. 4,040,562 to Ward et al., U.S. Pat. No. 4,812,700 to Natale, and U.S. Pat. No. 6,139,222 to Hains, all of which are incorporated herein by reference. By way of example, the multilayer film can be shaped as desired and heat sealed to form seams. Upon filling, the containment bag can be sealed with an adhesive or by a heat sealing method, as desired.

As is shown schematically in FIG. 2, the radiological waste 22 contained in the containment bag 20 (e.g., $^{238}Pu$) can emit alpha particle radiation 24. As discussed above, in one embodiment, the sacrificial layer 14 can include a net positive charge, which can serve to repel the alpha particles from the bag 20 on a nanometer scale. In any case, the sacrificial layer includes one or more alpha particle energy absorbers that can absorb energy either through ionization or electron excitation. Accordingly, the sacrificial layer will be subjected to radiolysis and degradation over time, but the presence of the sacrificial layer can delay degradation of the outer polymeric layer 12 and extend the life of the bag.

In those embodiments in which the sacrificial layer also includes a chromophore and/or the bag includes a detection layer, the containment bag can be monitored for the emission spectra and/or the color of the chromophore. As the layer containing the chromophore begins to degrade, this can alter the emission spectra and/or the color, either through a loss in emission, a change in emission wavelength, or a change in the absorption/reflection characteristics (i.e., the color), depending upon the specific chromophore incorporated, and this alteration can be detected. Suitable detectors can depend upon the nature of the particular chromophore utilized (e.g., the emission wavelength), as is known. For example, in one embodiment, the chromophore can emit at a detectable wavelength upon excitation via the alpha particle radiation, and alternation in this emission can be monitored. Alternatively, the bag can be monitored by use of an external excitation source, and alteration in emission in response to this external source can be monitored.

In one particular embodiment, the chromophore of the sacrificial and/or detection layer(s) can provide a visually detectable signal, and an excitation and/or detection device such as a spectrometer may not be needed. For instance, the chromophore can appear to have a certain color or can be clear upon formation of the layer, and upon decomposition or radiolysis the chromophore will be chemically altered (e.g., loss of a constituent group) and the visual appearance of the chromophore will change. The alteration in the chromophore upon degradation or radiolysis can be any alteration that leads to a detectable change including, without limitation, loss of a constituent group, crystal structure alteration, oxidation, reduction, etc.

The present disclosure may be better understood with reference to the Example set forth below.

EXAMPLE

Sample preparation utilized two types of polymer substrates. The initial samples were prepared with polymethyl methacrylate (PMMA) and later samples were prepared with polyvinyl alcohol (PVA) or polyvinylpyrrolidone (PVP).

The samples were prepared using the following protocol:

1 —0.5 grams of PMMA was dissolved in 5 grams of DCM with constant stirring at room temperature.

2—The energy absorber was dissolved in DCM at 3 mg/mL concentration and added to the polymer solution.

3—The film was prepared by pouring the solution into a petri dish and allowing the solvent to evaporate off.

The PVA films were prepared similarly; however, the polymer was dissolved in water. Additionally, the water solubility preparation changed the available material to isopropanol, methanol, and water as the diluent for the energy absorbers.

Energy absorbers used included $LiBH_4C_{60}$, anthradithiophene, and graphene. Dopants were incorporated at moderate levels in some samples to help strengthen the polymer and make it more resistant to alpha degradation. Specifically, $Na_2WO_2$ and/or Aluminum Oxynitride (ALON) were included with the $LiBH_4C_{60}$ to improve alpha degradation resistance.

Figure 3:
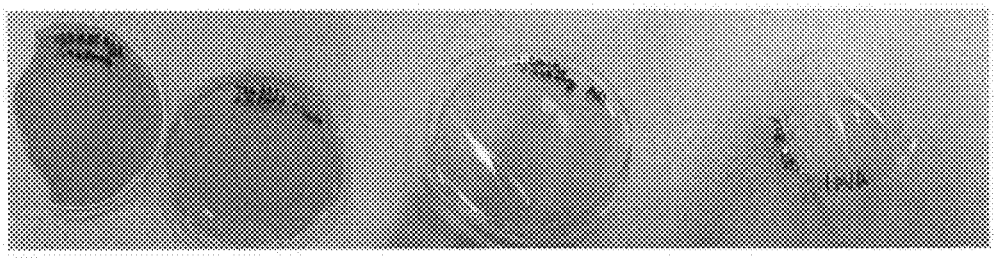
FIG. 3 illustrates a flexible composite material as may be used as a sacrificial layer as described herein.
Figure 5:
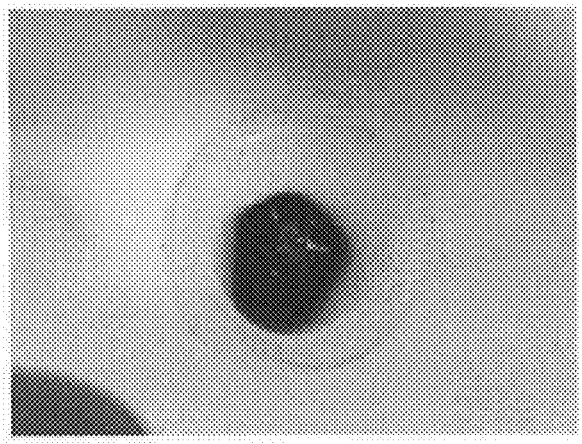
FIG. 5 illustrates a multilayer film following irradiation with helium-4 particles.

FIG. 3 illustrates the PMMA-based films (left panel) and PVA-based films (center and right panel). An 8 MeV electron accelerator was used to accelerate $^4He$ atoms at the samples at an energy of 5.5 MeV to represent an alpha particle without the contamination factor. This is comparable to the alpha particle irradiation experience within the gloveboxes at 235-F facility. FIG. 5 shows a polymer sample following exposure. As can be seen, the sample has only been damaged at the center and has not melted or decomposed any further.

Figure 4:
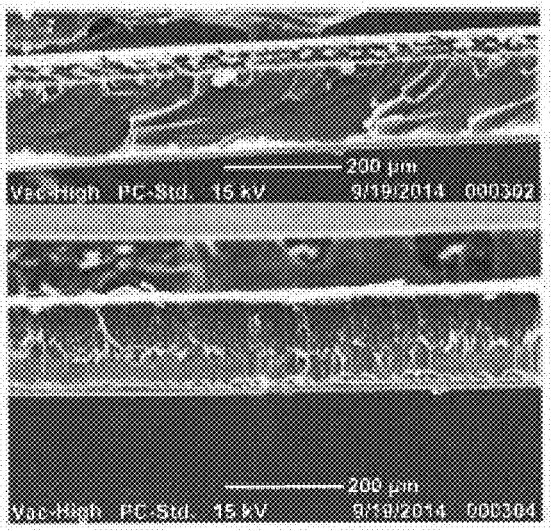
FIG. 4 presents scanning electron micrograph images of sacrificial films as described herein.

FIG. 4 presents scanning electron micrograph images of PVA thin films with the fullerene energy absorber (top panel) and the anthradithiophene dye (bottom) incorporated into the polymer. The $LiBH_4C_{60}$ material was about 200 μm thick while the anthracene material was about 180 μm thick. The inclusions shown in both samples were believed to be primarily as a result of how the material was cut.

Figure 6:
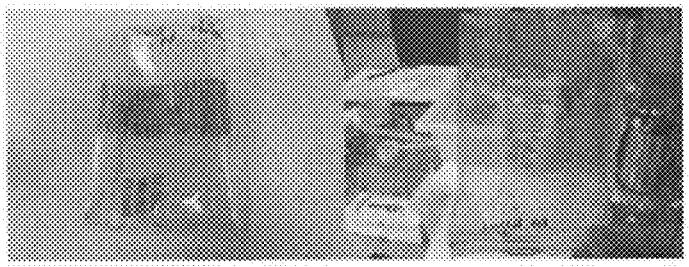
FIG. 6 illustrates a containment bag as described herein.

A prototype bag was made up by preparing the above described solution and drop casting it onto a flat surface of a commercially available polyethylene bag. The solvent was then allowed to evaporate without heating. The flat surface was then folded into bag shape and sealed on 3 sides using a hot press machine as a bag sealer. FIG. 6 illustrates the containment bag coated with $LiBH_4C_{60}$/PVA thin film by drop casting the liquid polymer and letting it dry.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A flexible composite material, the flexible composite material including a polymeric matrix, a first chromophore, and an alpha particle energy absorber incorporated in the polymeric matrix, the alpha particle energy absorber comprising a conjugated ring system comprising carbon and including at least two conjugated rings, the alpha particle energy absorber further comprising a metal hydride.

2. The flexible composite material of claim 1, wherein the first chromophore comprises a substituted or unsubstituted phenyl group, a substituted or unsubstituted anthracyl group, a substituted or unsubstituted phenanthryl group, a substituted or unsubstituted naphthyl group, a substituted or unsubstituted heterocyclic ring, or combinations thereof.

3. The flexible composite material of claim 1, wherein the first chromophore comprises one or more of anthracene, tetracene, pentacene, naphthodiothiophene, or anthradithiophene, or combinations thereof.

4. The flexible composite material of claim 1, comprising a second alpha particle energy absorber.

5. The flexible composite material of claim 1, the flexible composite material having a net positive charge.

6. The flexible composite material of claim 5, wherein the polymeric matrix comprises a polymer having a positive charge.

7. The flexible composite material of claim 1, the polymeric matrix comprising a polyvinyl alcohol, a polyurethane, a polyolefin, a polyacrylate, a cellulose, a polyester, a polyisoprene, a polystyrene, a polysulfone, a polycarbonate, a polyoxymethylene, a polytetrafluoro ethylene, a polyetherketone, a polysiloxane, an elastomer, or a copolymer or blend comprising one or more thereof.

8. The flexible composite material of claim 1, the alpha particle energy absorber having an electron density of about $3.0\times10^{23}$ electrons per cubic centimeter or greater.

9. The flexible composite material of claim 1, wherein the conjugated ring system comprising carbon comprises a fullerene, graphene, or a carbon nanotube.

10. The flexible composite material of claim 1, wherein the alpha particle energy absorber comprises $C_{60}$ derivatized with the metal hydride.

11. The flexible composite material of claim 1, further comprising a second chromophore.

12. The flexible composite material of claim 1, wherein the metal hydride comprises $NaAlH_4$, $LiAlH_4$, or $LiBH_4$.

13. A flexible composite material, the flexible composite material including a polymeric matrix, a first chromophore, and an alpha particle energy absorber incorporated in the polymeric matrix, the alpha particle energy absorber comprising a heteroaryl conjugated ring system and a metal hydride.

14. The flexible composite material of claim 13, the flexible composite material having a net positive charge.

15. The flexible composite material of claim 13, wherein the polymeric matrix comprises a polymer having a positive charge.

16. The flexible composite material of claim 13, wherein the heteroaryl conjugated ring system comprises one or more of furan, pyrrole, and thiophene.

17. The flexible composite material of claim 13, wherein the heteroaryl conjugated ring system comprises anthracene, tetracene, pentacene, naphthodithiophene, or anthrdithiophene.

* * * * *